US005091753A

United States Patent [19]

Slapelis

[11] Patent Number: 5,091,753

[45] Date of Patent: Feb. 25, 1992

[54] CLEANING APPARATUS HAVING A SURFACE-CONFORMING BLADE

[75] Inventor: Vito Slapelis, Webster, N.Y.

[73] Assignee: Eastman Kodak Company, Rochester, N.Y.

[21] Appl. No.: 699,119

[22] Filed: May 13, 1991

[51] Int. Cl.[5] ..... G03G 21/00

[52] U.S. Cl. ..... 355/297; 355/299; 355/301; 118/652; 15/256.51; 15/256.52

[58] Field of Search ..... 355/297-299, 355/301; 118/652; 15/256.5, 256.51, 256.52

[56] References Cited

U.S. PATENT DOCUMENTS 4,174,172 11/1979 Lane ..... 15/256.51
4,501,620 2/1985 Oda ..... 134/6
4,740,818 4/1988 Tsilibes et al. ..... 355/14 R
4,827,311 5/1989 Bothner et al. ..... 355/297
4,851,880 7/1989 Ziegelmuller et al. ..... 355/302
4,870,449 9/1989 Brown ..... 355/297

*Primary Examiner*—R. L. Moses
*Attorney, Agent, or Firm*—Tallam I. Nguti

[57] ABSTRACT

Apparatus for cleaning a surface such as an image-bearing surface includes a flexible blade that has a cleaning edge that uniformly conforms to such surface, and a cleaning brush that contacts and uniformly loads the cleaning edge against such surface. The cleaning apparatus includes float mounting members for supporting the blade such that the cleaning edge thereto is free to float relative to the surface being cleaned.

16 Claims, 2 Drawing Sheets

CLEANING APPARATUS HAVING A SURFACE-CONFORMING BLADE

BACKGROUND OF THE INVENTION

1. Field of the Invention

This invention relates to cleaning apparatus for removing residual developer and other particles from a developer-contact surface in an electrostatographic copier or printer. More particularly, this invention relates to such a cleaning apparatus that has a cleaning blade which uniformly conforms to the contour of the surface being cleaned.

2. Background Art

Electrostatographic process apparatus which, for example, produce or reproduce toned images on selected substrates by employing electrostatic charges and toner particles on an insulated reusable photoconductive surface, typically operate through a sequence of currently well known steps. These steps include (1) charging of the insulated photoconductive surface with electrostatic charges, (2) forming a latent image electrostatically on such surface by selectively discharging areas on such surface, (3) developing the electrostatic image so formed with developer particles including toner particles, (4) transferring the toned image to a suitable substrate for fusing thereon to form a permanent record, and (5) cleaning developer-contact surfaces in such an apparatus with a cleaning device that removes residual developer and other particles from such surfaces in preparation for similarly producing another image.

Such cleaning is necessary because during this process, several surfaces in addition to the photoconductive surface within the electrostatographic apparatus, come into contact with, and are contaminated by the image-forming developer particles, for example, toner particles. The quality of the images produced by such an electrostatographic apparatus therefore depends significantly on the effectiveness of the cleaning device in cleaning the photoconductive surface for example before it is reused.

Several types of cleaning devices, including brush-type and blade-type devices have therefore been developed. Such devices or apparatus are disclosed, for example, in U.S. Pat. No. 4,870,449 issued Sept. 26, 1989 to Brown; No. 4,827,311, issued May 2, 1989 to Bothner et al; and No. 4,501,620, issued Feb. 26, 1985 to Oda. Typically, the cleaning blade of a blade-type cleaning apparatus consists of a long, thin flexible strip of material such as steel having first and second long edges. The first long edge thereto, for example, is a cleaning edge for mounting in scraping engagement with the surface to be cleaned. The second long edge is a mounting edge for rigidly mounting such a blade to a support member. As mounted, it is desirable for the cleaning edge thereof to load uniformly against, as well as make uniform contact with, the surface to be cleaned. Typically, the surface being cleaned is moved past the cleaning edge of such a mounted blade.

Unfortunately, however, spatial misalignments are a common problem between the cleaning edge of such a mounted blade and the surface to be cleaned. Such misalignments can be due to unfavorable mounting tolerances and/or runouts of the surface to be cleaned. Further complicating this problem is the fact that a long thin blade which is conventionally mounted and loaded usually cannot readily flex simultaneously along its width as well as along its length dimensions. The net consequence of this fact is that the cleaning edge of the blade cannot uniformly contact or uniformly load against the surface to be cleaned. The end result of all of this is that there may be poor and ineffective cleaning of the surface to be cleaned, and images formed using the electrostatographic apparatus in which the particular cleaning apparatus is used may have artifacts or other defects.

SUMMARY OF THE INVENTION

It is an object of the present invention to provide a cleaning apparatus that effectively removes residual developer and other particles from a developer-contact surface in an electrostatographic copier or printer.

It is another object of the present invention to provide such a cleaning apparatus which includes a cleaning blade having a cleaning edge that uniformly conforms to the surface to be cleaned.

It is also an object of the present invention to provide such a cleaning apparatus which includes means for uniformly loading a cleaning blade thereof against the surface to be cleaned.

In accordance with the present invention therefore, a cleaning apparatus is provided for removing residual developer and other particles from a moving developer-contact surface in an electrostatographic copier or printer. The cleaning apparatus includes a cleaning blade having a cleaning edge for making cleaning contact at a cleaning point with the surface being cleaned. The cleaning apparatus further includes means for mounting the cleaning blade such that the cleaning edge thereof can move floatingly in and out, up and down, as well as rotationally at the cleaning point relative to, and in response to, moving contact with the surface being cleaned. The cleaning apparatus also includes means for uniformly pressing and loading the cleaning edge into cleaning engagement at the cleaning point with the surface to be cleaned.

BRIEF DESCRIPTION OF THE DRAWINGS

In the detailed description of the invention presented below, reference is made to the drawings in which.

DETAILED DESCRIPTION OF THE PREFERRED EMBODIMENT

Figure 1:
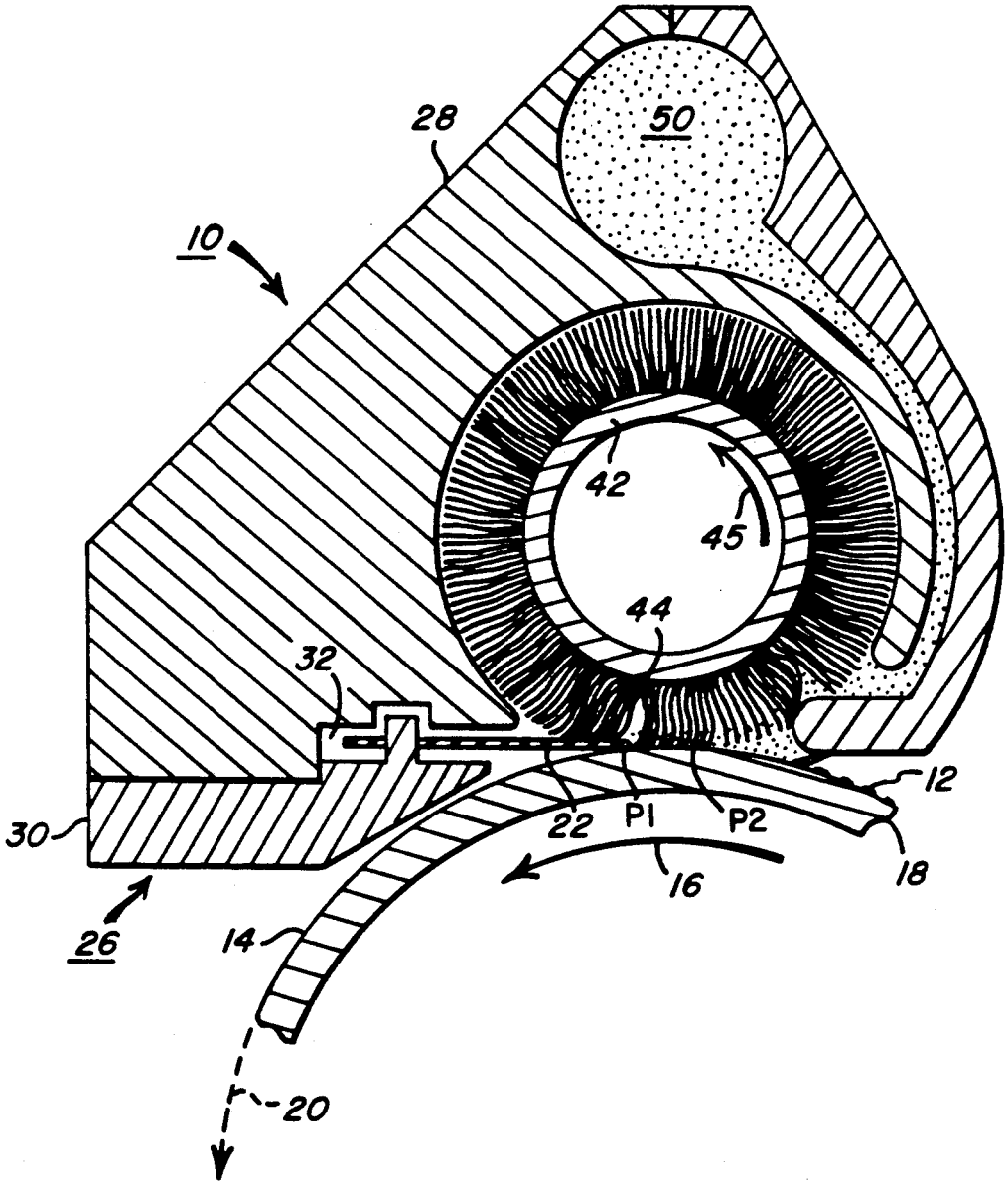
FIG. 1 is a cross section of the cleaning apparatus of the present invention against a surface to be cleaned.

Referring now to the drawings, the cleaning apparatus of the present invention is shown generally as 10. As shown, the cleaning apparatus 10 is suitable for effectively removing residual particles 12, such as developer material and other particles, from a developer-contact surface 14 (which is to be cleaned) in an electrostatographic reproduction apparatus such as a copier or printer (not shown). An example of such a copier is more fully disclosed in U.S. Pat. No. 4,740,818, issued Apr. 26, 1988 to Tsilibes et al., the contents of which are incorporated by this reference. As shown, the surface 14 is being moved, for example, in the direction of the arrow 16.

As is well known, in an electrostatographic copier or printer (not shown), the developer-contact surface 14 for example can be an image-bearing surface such as the photoconductive surface of the copier or printer, or such as the surface of an intermediate toner image transfer member. For this invention, however, the developer-contact surface 14 is any movable surface in such a copier or printer which comes into contact with developer material particles, such as toner and carrier particles, that are used for image development in such copier or printer. The cleaning apparatus 10 of the present invention will for example be described in detail with reference to its use when the surface 14 is the image-bearing surface of the moving photoconductive member 18 of such a copier or printer (not shown).

Referring now to FIG. 1, the cleaning apparatus 10 has first and second cleaning points P1, P2, respectively, at each of which residual developer and other particles 12 can be removed from the moving surface 14. The cleaning points P1 and P2 lie along a fixed path of movement 20 of the surface 14, and such that within the apparatus 10 the first cleaning point P1 is downstream of the second cleaning point P2 relative to the direction of movement of the surface 14.

As further shown, the cleaning apparatus 10 includes a first cleaning element 22 consisting of a scraper type cleaning blade. The first element or blade 22 is preferably a long and thin flexible strip of material, such as stainless steel, having a desired thickness T. The blade 22 has a cleaning portion or first edge 24 (FIG. 2) for making cleaning contact at the first cleaning point P1 with the moving surface 14 in order to remove residual developer and other particles thereat from such surface 14. Importantly, the first cleaning element or blade 22 includes float mounting means shown generally as 26 for mounting such blade 22 floatingly relative to the surface 14 at the first cleaning point P1.

Figure 2:
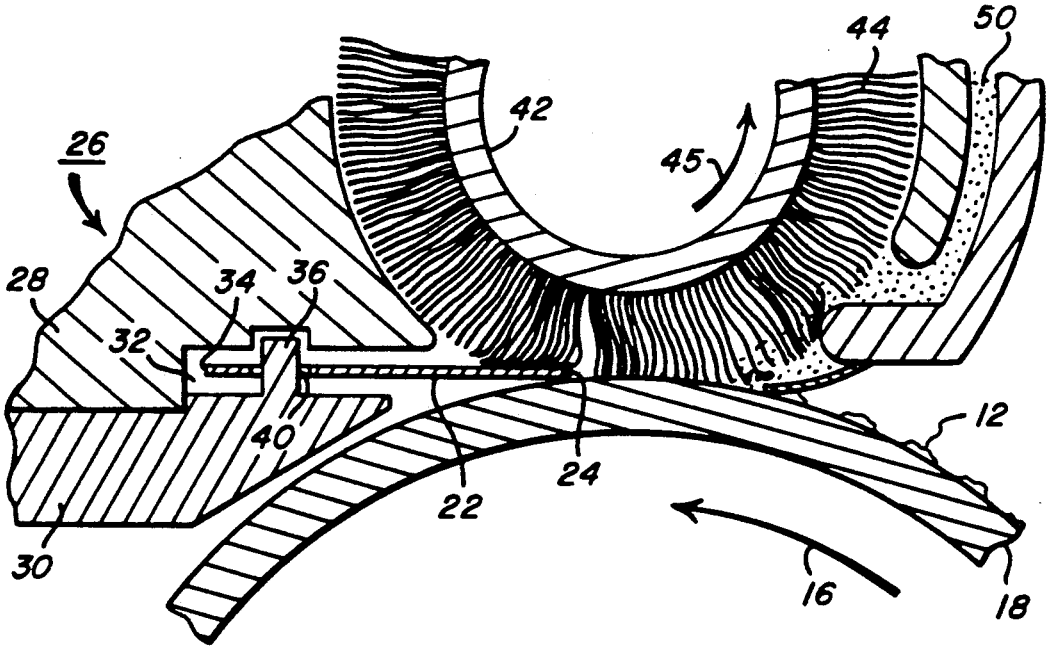
FIG. 2 is an enlarged portion of FIG. 1.
Figure 3:
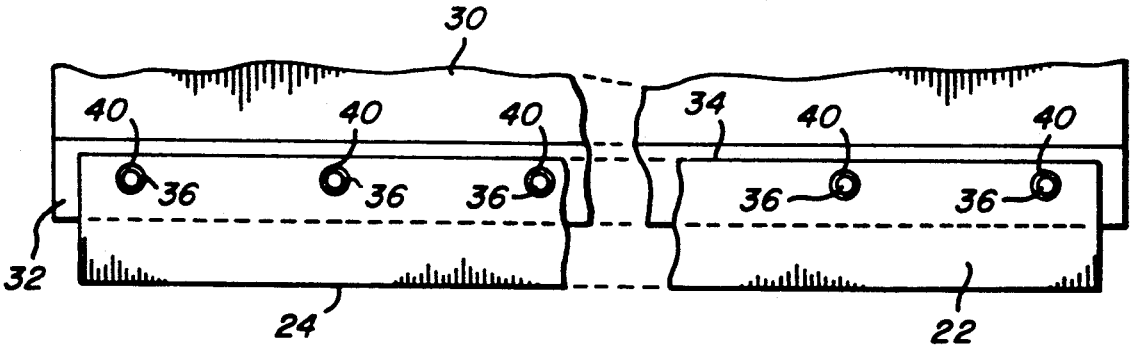
FIG. 3 is a top plan view of part of the floating mounting means of the present invention showing the retaining pins and mounting apertures of the mounting means.

The float mounting means 26 as shown in FIGS. 2 and 3 includes a housing member 28 and a support member 30 for supporting the first cleaning element or blade 22 so that the cleaning edge 24 thereof is at P1. The support member 30 can be connected or attached to the body 28 by suitable means (not shown) or it can be formed integrally with such housing 28. The mounting means 26 also includes a float gap 32 which, as shown, is defined by part of the housing 28 and by part of the support member 30. The float gap 32 is for accommodating the second long edge 34 of the blade 22, as well as a good portion of the width of such blade 22 adjacent the second edge 34. In order to allow for floating movement of the blade 22 within the gap 32, the gap 32 is formed so that it is wider than the thickness T of the blade 22. Within the gap 32, a plurality of blade retaining pins 36 associated with the support means 26 are provided. The retaining pins 36 for example can be connected to the blade support member 30 as shown. In any case, each pin 36 should have a predetermined diameter d1, and should project from the support member 30 partially, for example, into the float gap 32. As shown, the retaining pins 36 are also spaced apart from each other along the length of the support member 30.

Additionally, blade mounting apertures 40 are provided through the thickness T of the blade 22, and such that they lie towards the second long edge 34 of the blade 22 for receiving the retaining pins 36. The apertures 40 are shown as round holes but they can also be slots or other appropriate shape. The apertures 40 are spaced apart on the blade 22 so as to correspond substantially with the spacing of the retaining pins 36 on the support member 30. Each aperture 40 should have a predetermined diameter d2 which is substantially greater than the predetermined diameter d1 of the corresponding retaining pin 36. This is so that when the blade 22 is properly assembled onto the pins 36, the blade will be free to move or float through significant distances up and down, forward and backward, side to side, and rotationally within the gap 32 and relative to the retaining pins 36. Such floating movement of the blade 22 about the retaining pins 36 of course results directly into similar floating or substantially universal movement of the cleaning edge 24 of the blade 22 relative to the surface 14 at the first cleaning point P1. As a consequence of such movement, the cleaning edge 24 of the blade 22 is therefore free to simultaneously flex or twist lengthwise, and tilt widthwise, and in so doing conforms uniformly and readily to the outline or contour of the surface 14 at the first cleaning point P1. The floating blade 22 will conform to the contour of the surface 14 as such, even if the surface 14 is not perfectly straight, and even if it includes a runout thereacross, Referring now to FIGS. 1 and 2, the cleaning apparatus 10 further includes a second cleaning element consisting of an elongate rotatable fiber brush 42 which is at least as long as the blade 22. As shown, the brush 42 includes compressible flexible bristles 44. A suitable known brush is dislosed, for example, in U.S. Pat. No. 4,851,880, issued July 25, 1989 to Ziegelmuller et al. As mounted within the housing 28 the brush 42 can be rotated by a motor or belt drive, for example, in the direction of the arrow 45 so that the bristles 44 are moved past the first and second cleaning points P1 and P2. The brush is mounted such that at the first cleaning point P1 the bristles 44 make significant contact with the cleaning portion or first edge 24 of the blade 22, and such that at the second cleaning point P2, the same bristles 44 make cleaning contact with the moving surface 14. More importantly, the bristles 44 should make such first contact with the blade 22 just downstream of the first cleaning point P1. Such first contact will be leveraged at the point P1 and will therefore uniformly press and load the cleaning edge 24 into cleaning engagement against the moving surface 14 at the cleaning point P1. The resilient bristles 44 then should maintain such pressing and loading contact with the blade 22 while moving upstream past the first cleaning point P1 toward the second cleaning point P2.

The bristles 44 then make desired cleaning contact with the moving surface 14 at the second cleaning point P2 for removing residual developer and other particles thereat from such surface 14. As such, the residual particles are removed from the surface 14 by the loaded edge 24 of the blade 22 at point P1, and by the bristles 44 at point P2. As shown, it is preferable that within the cleaning region defined by cleaning points P1, P2, the brush 42 is moving or rotating in a direction that is opposite to that of the moving surface 14. This is preferable for example, because the effect of the brush on the scraper blade 22 should be to press and load the edge 24 thereof into the moving surface 14 rather than to tend to lift such edge 24 up and away from such surface 14.

The cleaning apparatus 10 also contains transport means such as vacuum means 50 for removing cleaned off residual developer and other particles from the bristles 44 of the brush 42 downstream of points P1, P2 relative to the movement of the bristles 44, and for transporting such particles out of the housing 28, and away from the surface 14. The brush 42 additionally also acts as part of the transport means by moving the residual particles, which are first removed by the cleaning edge 24 at the first cleaning point P1, from such point P1, to and through the second cleaning point P2 for subsequent release into the vacuum means 50.

As can be seen, the cleaning apparatus 10 includes a floating cleaning blade 22 that is free to move significantly in a substantially universal manner relative to the surface 14 being cleaned at a point of cleaning contact P1. As such the blade 22 can uniformly conform to, as well as be uniformly loaded against the surface 14. Additionally, the apparatus 10 includes a rotatable fiber brush 42 with compressible fibers or bristles 44 for uniformly pressing and loading the blade 22 into cleaning engagement with the surface 14. The bristles 44 of the brush also remove and transport residual developer and other particles away from the surface 14. There is therefore no need in the cleaning apparatus 10 of the present invention for finely adjusting for parallelism between the surface 14 and the cleaning edge 24 of the blade 22, or for lack of uniform loading of the blade 22 against such surface 14.

The invention has been described in detail with particular reference to a presently preferred embodiment, but it will be understood that variations and modifications can be effected within the spirit and scope of the invention.

What is claimed is:

1. A cleaning apparatus for removing particles from a moving surface in an electrostatographic reproduction apparatus, the cleaning apparatus including:

(a) a cleaning blade having a cleaning edge for making cleaning contact at a cleaning point P1 with the surface being cleaned;

(b) float mounting means for mounting said cleaning blade such that said cleaning edge thereof can move floatingly in and out, up and down, and rotationally at said cleaning point P1 relative to, and in response to moving contact with the surface being cleaned; and (c) means for uniformly pressing and loading said cleaning edge of said blade into cleaning engagement with the surface being cleaned.

2. A cleaning apparatus for removing residual developer particles from a moving surface in an electrostatographic reproduction apparatus, the cleaning apparatus including:

(a) first and second cleaning points P1 and P2 at each of which toner particles are removable from such a surface, said first and second cleaning points P1, P2 lying in a fixed path of the moving surface being cleaned;

(b) a first cleaning element including a cleaning portion thereof positioned at said first cleaning point P1 for removing toner particles thereat from the moving surface being cleaned, said first cleaning element being mounted such that said cleaning portion thereof can move at said first cleaning point P1 in response to contacting movement thereat by the moving surface being cleaned; and (c) a second cleaning element for removing toner particles at said second cleaning point P2 from the moving surface being cleaned, said second cleaning element being mounted so as to be movable through said first and second cleaning points P1, P2 such that said second cleaning element first contacts and loads said cleaning portion of said first cleaning element into cleaning engagement with the moving surface being cleaned at said first cleaning point P1, and then contacts and cleans such surface being cleaned at said second cleaning point P2.

3. The cleaning apparatus of claim 2 including means for transporting the removed toner particles away from the surface being cleaned.

4. The cleaning apparatus of claim 2 wherein said first cleaning point P1 is downstream of said second cleaning point P2 relative to the movement of the surface being cleaned.

5. The cleaning apparatus of claim 2 wherein said first cleaning element is a scraper blade.

6. The cleaning apparatus of claim 2 wherein said second cleaning element is a fiber brush.

7. The cleaning apparatus of claim 2 wherein said cleaning portion of said first cleaning element is a scraping edge.

8. The cleaning apparatus of claim 2 wherein said cleaning portion of said first cleaning element can move substantially universally at said first cleaning point P1 relative to the surface being cleaned.

9. The cleaning apparatus of claim 2 wherein said first cleaning element includes float mounting means for mounting said first cleaning element so that said first cleaning element can move floatingly relative to the surface being cleaned.

10. The cleaning apparatus of claim 2 wherein said second cleaning element is mounted so as to be movable rotatably through said first and second cleaning points P1, P2.

11. The cleaning apparatus of claim 2 wherein at said first and second cleaning points P1, P2 said second cleaning element is being moved in a direction relatively opposite that of the moving surface being cleaned.

12. The cleaning apparatus of claim 2 wherein said second cleaning element first makes loading contact with said cleaning portion of said first cleaning element at a point Just downstream of said first cleaning point P1 and then maintains such loading contact with said first cleaning element while moving through said first cleaning point P1.

13. The cleaning apparatus of claim 2 wherein said second cleaning element in moving through said first cleaning point P1 contacts and transports therefrom toner particles removed at said first point P1 by said cleaning portion of said first cleaning element from the moving surface being cleaned.

14. The cleaning apparatus of claim 3 wherein said transport means includes vacuum means for moving toner particles away from the surface being cleaned.

15. A cleaning apparatus for removing toner particles from a moving surface to be cleaned in an electrostatographic apparatus, the cleaning apparatus comprising:

(a) a cleaning blade having a cleaning tip adapted to be positioned at a first cleaning point P1 on the surface being cleaned for removing toner particles from such surface;

(b) float mounting means for supporting said cleaning blade such that said cleaning tip thereof is movable floatingly at said first cleaning point P1 relative to the surface being cleaned; and (c) means including a rotatable fiber brush adapted to be positioned to engage the surface being cleaned for removing toner particles at a second cleaning point P2 from the surface being cleaned, said fiber brush being mounted so as to be rotatably movable through said first and second cleaning points P1, P2 such that said fiber brush contacts and loads said cleaning tip of said cleaning blade into cleaning engagement against the surface to be cleaned, and such that said fiber brush also engages the surface to be cleaned at said second cleaning point P2 for removing toner particles therefrom.

16. The cleaning apparatus of claim 15 wherein said float means includes:

(a) a housing member of said apparatus;

(b) a blade support member connected to said housing member;

(c) a float gap for accommodating the thickness T of said blade, said gap being larger than said thickness T of said blade, and said float gap being defined by said support member and said housing member;

(d) spaced blade retaining pins connected to said support member and projecting into said float gap, each said retaining pin having a predetermined diameter d1; and (e) spaced mounting apertures in said blade for receiving said blade retaining pins, said mounting apertures being spaced correspondingly to said spaced retaining pins, and each said aperture having a diameter d2 substantially greater than the diameter d1 of a corresponding retaining pin.

* * * * *